United States Patent [19]

Schwarten

[11] Patent Number: 4,669,157

[45] Date of Patent: Jun. 2, 1987

[54] MAUSOLEUM CONSTRUCTION

[76] Inventor: Jerry C. Schwarten, 5131 N. Cumberland Blvd., Whitefish Bay, Wis. 53217

[21] Appl. No.: 700,412

[22] Filed: Feb. 11, 1985

[51] Int. Cl.[4] ..... A61G 17/00; E04H 13/00; A47G 29/00

[52] U.S. Cl. ..... 27/1; 27/7; 211/71; 52/134

[58] Field of Search ..... 27/7, 8, 35, 1; 52/128, 52/129, 134, 136, 137, 138; 211/71

[56] References Cited

U.S. PATENT DOCUMENTS

| | | | |
|---|---|---|---|
| 785,591 | 3/1905 | Conez | 211/71 X |
| 892,458 | 7/1908 | Sparks | 52/134 X |
| 1,026,044 | 5/1912 | Little | 27/7 |
| 1,054,289 | 2/1913 | Goodrich | 27/7 |
| 1,406,192 | 2/1922 | Kennedy | 52/134 X |
| 1,453,375 | 5/1923 | Allen | 52/134 |
| 1,631,239 | 6/1927 | Zengerle | 52/129 |
| 3,159,901 | 12/1964 | Harrington et al. | 27/7 |
| 3,172,183 | 3/1965 | Bugg | 27/7 |
| 3,199,683 | 8/1965 | Graswich | 211/71 |
| 3,501,215 | 3/1970 | Gartner | 52/128 X |
| 3,527,359 | 9/1970 | Lambertson | 211/71 |
| 3,978,627 | 9/1976 | Booth | 52/136 |
| 3,986,308 | 10/1976 | Jones | 52/134 |
| 4,073,100 | 2/1978 | DiGiovanni, Jr. | 52/79.3 |
| 4,253,220 | 3/1981 | Work | 27/35.7 |

*Primary Examiner*—Robert A. Hafer
*Assistant Examiner*—D. Neal Muir
*Attorney, Agent, or Firm*—Foley & Lardner

[57] ABSTRACT

An improved mausoleum includes a support frame made of fiberglass structural members and a plurality of sealed fiberglass caskets which are proof against deterioration. The mausoleum according to the invention eliminates the need for venting and drainage, greatly simplifies construction of the mausoleum, and reduces funeral expenses. In preferred embodiments, each of the fiberglass caskets has a pair of central lateral flanges, and the support structure includes a plurality of pairs of parallel rails made of fiberglass spaced apart so that the caskets can be inserted between the rails and supported thereon by the central lateral flanges of each casket.

8 Claims, 8 Drawing Figures

MAUSOLEUM CONSTRUCTION

FIELD OF THE INVENTION

The present invention relates to an improved mausoleum system, and more particularly to a mausoleum utilizing fiberglass caskets and a fiberglass support structure, which is highly economical and eliminates the need for venting or draining the mausoleum.

BACKGROUND OF THE INVENTION

A conventional mausoleum is constructed of concrete and comprises a subdivided vault defining burial chambers therein. A burial casket, usually made of wood, is inserted through an opening in one wall of the mausoleum into one of these chambers, and the chamber is then sealed with a marble face plate, upon which the names and dates of the deceased will be inscribed or affixed.

This traditional type of mausoleum is disadvantageous in a number of respects. In particular, the caskets tend to deteriorate over time and emit body fluids and gases. Accordingly, adequate venting and drainage systems must be incorporated into the mausoleum to remove the fluids and gases and to prevent perceptible leakage of odorous fluids and gases from the mausoleum. Further, conventional mausoleums are relatively expensive to construct. A conventional mausoleum employs a honeycomb construction including top, bottom and side walls for each burial chamber, thus requiring large quantities of materials. Examples of such conventional mausoleums are described in the following U.S. Pat. Nos. 892,458, to Sparks, issued July 7, 1908; 1,453,375, to Allen, issued May 1, 1923; 3,986,308, to Jones, issued Oct. 19, 1976, and 3,978,627, to Booth, issued Sept. 7, 1976.

Alternative mausoleum systems are also known. For example, DiGiovanni Jr., U.S. Pat. No. 4,073,100, isssued on Feb. 14, 1978 describes a mausoleum utilizing a plurality of preformed, molded, fiberglass or plastic crypts interlocked at respective crypt corners to form stacks.

Another example is described in Kennedy U.S. Pat. No. 1,406,192 issued on Feb. 14, 1922 wherein a sectional enclosure formed of vertically disposed I-beams coupled to horizontal parallel crossbars receives caskets on respective pairs of rails disposed between the respective crossbars.

However, such alternative mausoleum system construction are disadvantageous in that they require excessive quantities of materials and/or fail to prevent crypt leakage.

In addition, burial caskets formed of concrete or plastic with reinforcing members embedded in the bottom and sides thereof projecting laterally outward from the sides of the casket are known. Such a casket is described in Little U.S. Pat. No. 1,026,044 issued on May 14, 1912. Burial vaults including a base and a cover molded from a plastic resinous material are also known. See U.S. Pat. No. 4,253,220 issued on Mar. 3, 1982 to Work.

SUMMARY OF THE INVENTION

The present invention provides a mausoleum system which is relatively inexpensive to construct, while at the same time attractive and providing improved integrity of interment. Specifically, the mausoleum utilizes affirmatively sealed caskets formed of reinforced fiberglass which cooperate with a support structure formed of fiberglass I-beams to eliminate the need for internal venting and drainage in the mausoleum. Further, simplicity of construction is accomplished by utilizing caskets including lateral flanges on the sides thereof to facilitate disposition within the support structure.

More particularly, a mausoleum according to one aspect of the present invention includes a fiberglass support structure which supports a plurality of fiberglass caskets in spaced apart relationship, and a surrounding enclosure or housing. The fiberglass components used in the present invention are substantially proof against deterioration, water and rust.

In accordance with another aspect of the present invention, each of the caskets comprises a lower, trough-shaped, upwardly opening crypt couch made of fiberglass having an upper peripheral lateral flange, and an upper, trough-shaped, downwardly opening cover made of fiberglass having a lower peripheral lateral flange which is superposed on the upper flange of the crypt couch. Means such as a layer of sealant bonds the flanges together in an airtight fashion. The structural members of the support structure which supports these caskets are made entirely of fiberglass and are joined together by means such as fasteners, which fasteners may be made of fiberglass or any other suitable material, such as stainless steel.

BRIEF DESCRIPTION OF THE DRAWING

A preferred exemplary embodiment of the present invention will hereinafter be described in conjunction with the appended drawing, wherein like numerals denote like elements, and:

In FIGS. 4 through 8, appropriate portions of the mausoleum housing are broken away in order to show the interior structure thereof. In FIGS. 4, 5 and 7, the portions removed include the front wall of the mausoleum and the I-beams which connect the inner support structure with the front wall.

DETAILED DESCRIPTION OF A PREFERRED EXEMPLARY EMBODIMENT

Figure 1:
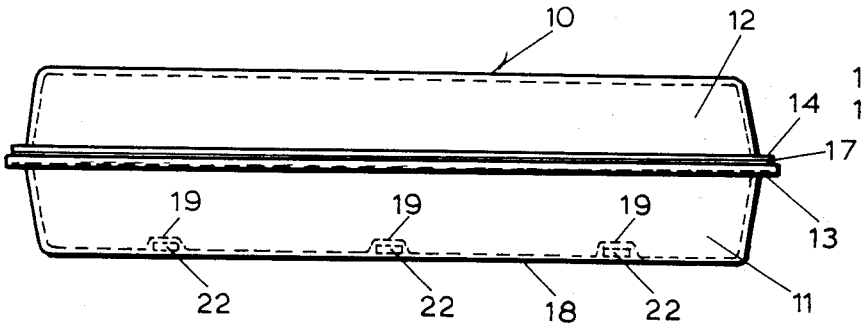
FIG. 1 is a side view of a casket according to the present invention, with the interior shown in phantom.
Figure 2:
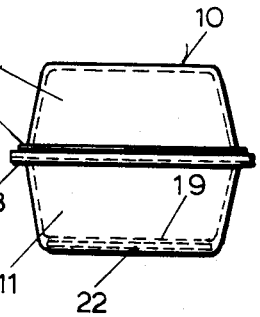
FIG. 2 is an end view of the casket shown in FIG. 1, with the interior shown in phantom.
Figure 3:
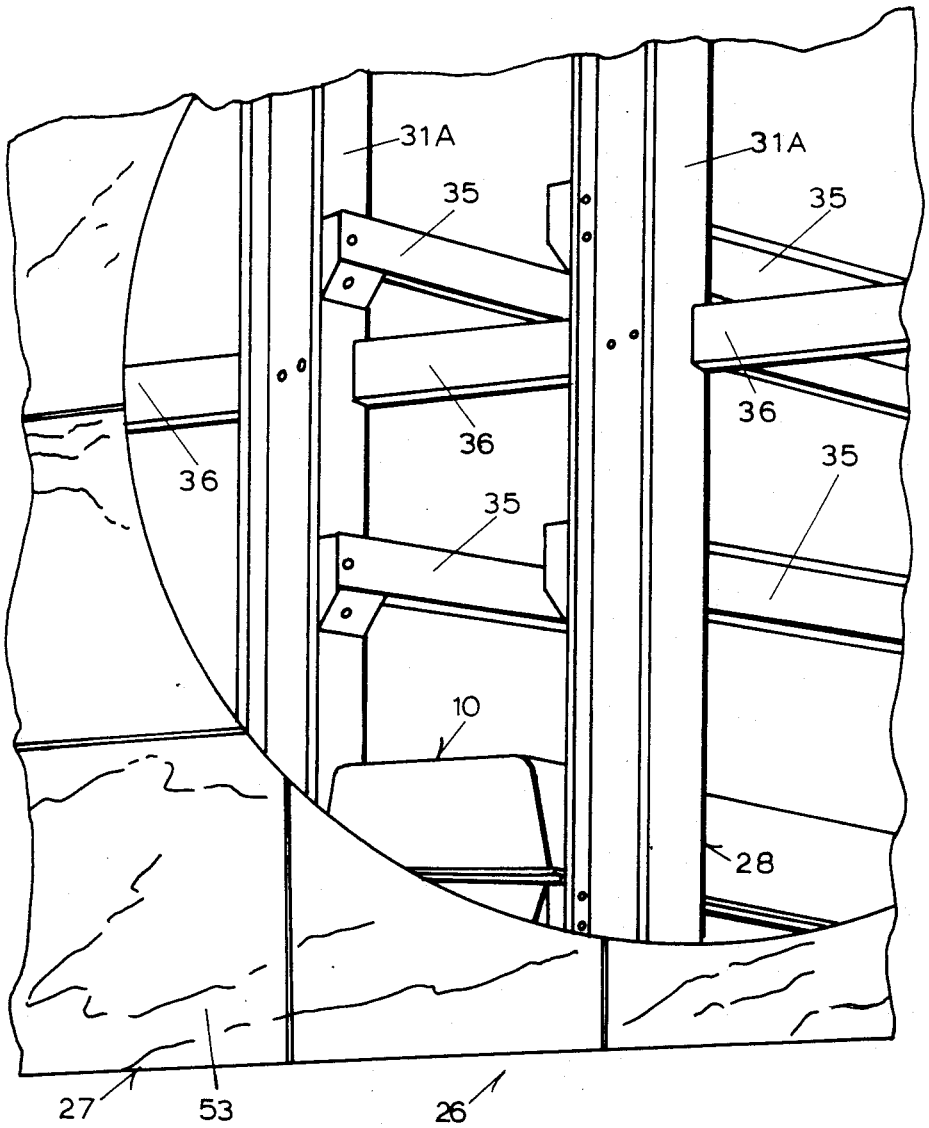
FIG. 3 is a partial, perspective, partially broken away view of the front of a mausoleum construction according to the invention.
Figure 4:
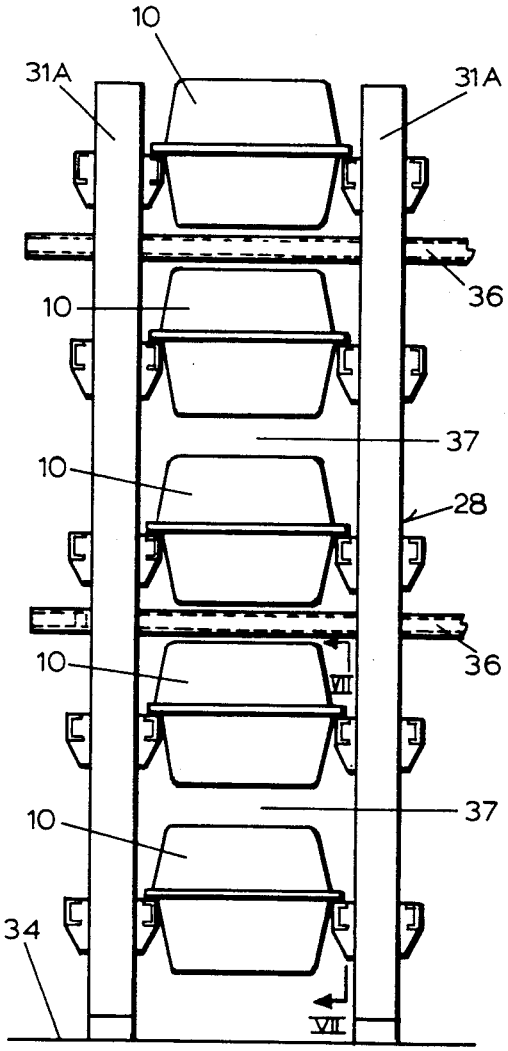
FIG. 4 is a partial front view of the support structure of the mausoleum shown in FIG. 3.

Referring now to FIGS. 1–3, a mausoleum system 26 in accordance with the present invention, comprises a support structure 28, formed of a plurality of fiberglass members 31, 35, 36, for receiving respective caskets 10, and an ornamental facade (housing) 27.

With specific reference now to FIGS. 1 and 2, a fiberglass casket 10, according to one aspect of present invention will be described. Casket 10 comprises an elongated bottom section (crypt couch) 11 and a generally symmetrical top (cover) 12. Crypt couch 11 and cover 12 are suitably substantially trough-shaped, and include respective peripheral lateral flanges 13 and 14. Flanges 13 and 14 are adapted to mate in sealing engagement, to provide an essentially air and fluid tight enclosure for receiving the deceased. A sealant mechanism, such as a layer of sealant 17, is disposed in cooperation with flanges 13, 14 to facilitate an airtight seal. Flanges 13, 14, secured together in mating relationship, are of sufficient strength to support the entire weight of casket 10, as will be explained in detail below.

The bottom wall 18 of crypt couch 11 includes three enlarged, elongated inner ridges 19 embedded therein. Ridges 19 extend transversely across the entire width of the bottom wall 18 and project upwardly from the inner surface of the bottom wall 18. A strip of reinforcing material 22, suitably a wooden board, is embedded in each of the ridges 19, to insure against buckling and sagging of casket 10 due to the weight of the interred body. Reinforcing strips 22 are preferably about 0.5–2 inches thick and 2–6 inches wide, particularly about 1 by 3 inches in cross-section. Preferably, at least two of these reinforcing strips 22 are employed, with a corresponding number of ridges 19.

Referring now to FIGS. 3 through 8, outer housing 27 is suitably rectangular and generally formed of cement. As will hereinafter be more fully explained, housing 27 includes a cement floor 34 (FIG. 5) and a front wall formed of ornamental panels 53, suitably marble.

Figure 5:
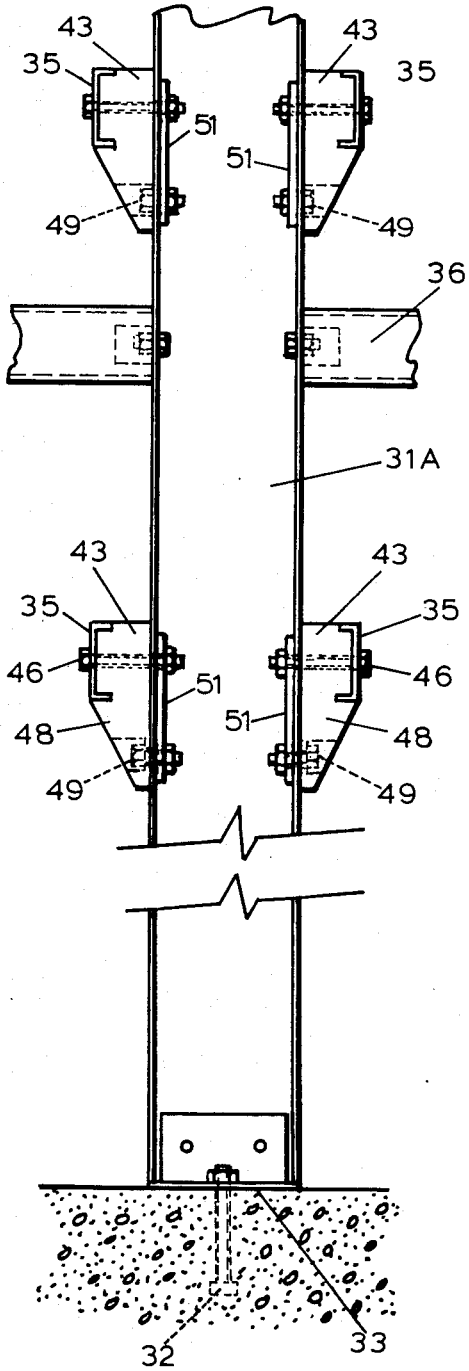
FIG. 5 is an enlarged, partial front view of a supporting I-beam with attached rails and crossbars, as shown in FIG. 4.

Support structure 28 is disposed within housing 27 for receiving the respective caskets 10. Support structure 28 is suitably formed of a plurality of vertically disposed fiberglass I-beams 31. Vertical I-beams 31 are disposed in spaced apart relation, suitably secured at the lower end plate 33 thereof to concrete floor 34 by a nut and bolt assembly 32 (FIG. 5). Respective transverse fiberglass members rails 35 and lateral fiberglass members (crossbars) 36 interconnect transversely adjacent and laterally adjacent vertical beams 31, respectively. The matrix of vertical beams 31 suitably includes three lateral parallel rows (i.e., respective sets of front, middle and rear vertical beams 31A, 31B and 31C respectively). If desired, alternative arrangements of vertical I-beams 31 can be utilized. For example, vertical beams 31 can be disposed in a matrix of only two rows, or more than three rows can be utilized.

The relative disposition of vertical beams 31 corresponds to the dimensions of caskets 10. As will hereinafter be more fully explained, respective pairs of adjacent lateral members 35 are disposed to selectively underlie and slideably receive peripheral flange 13 of casket 10 to support and maintain casket 10 within the structure 28. If desired, rails 35 can be of sufficient length to accommodate a plurality of caskets 10. Access to the rails can be provided, if desired, through a single decorative front panel 53, or throuqh respective panels 53 at the front and rear of the enclosure.

Caskets 10 are suitable disposed within structure 28 by removing the decorative panel 53 forward of the particular set of rails 35 to receive the casket 10. Access is thus provided to the supporting structure, and casket 10 is inserted through the access with flange 13 in overlying relationship with the respective rails 35. If desired, access can be provided through removable panels at both the front and rear of the housing.

Figure 6:
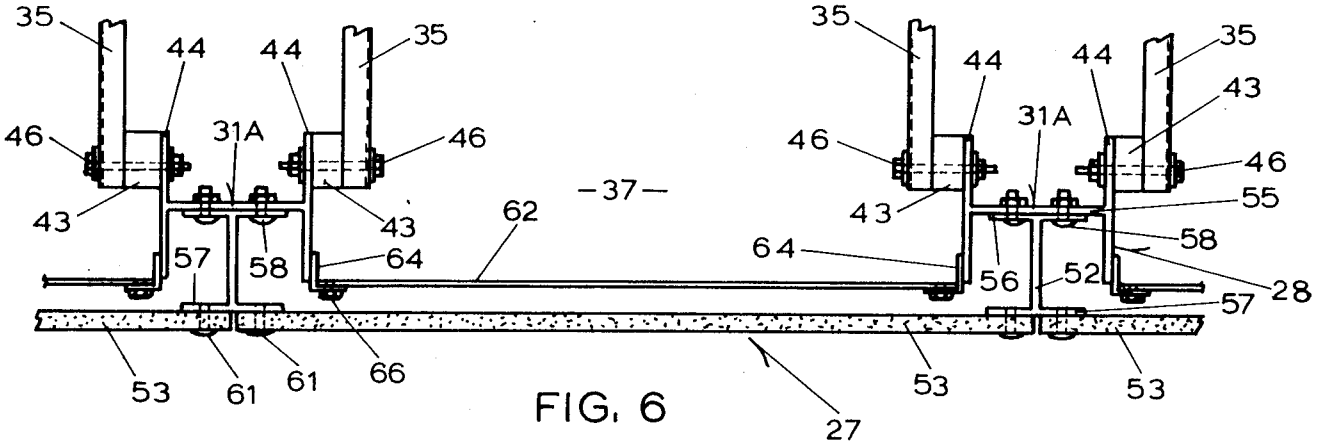
FIG. 6 is a partial plan view of a front end portion of a burial chamber as shown in FIG. 3.

With reference now to FIGS. 5 and 6, the mounting of rails 35 will be more fully described. Each of the I-beams 31 has a plurality of cantilevered mounting brackets 43 laterally mounted thereon, disposed vertically spaced apart at regular intervals sufficient to clear the height of casket 10. Brackets 43 are secured to the outer surfaces of opposing end flanges 44 of the I-beams 31 by nut and bolt assemblies 46. The brackets 43 have downwardly tapering lower-end portions 48 and are further secured to the associated I-beam 31 by countersunk nut and bolt assemblies 49. The nut and bolt assemblies 46, 49 are threaded through a strip washer 51 which is in face-to-face contact with the inner surface of the associated flange 44.

Figure 7:
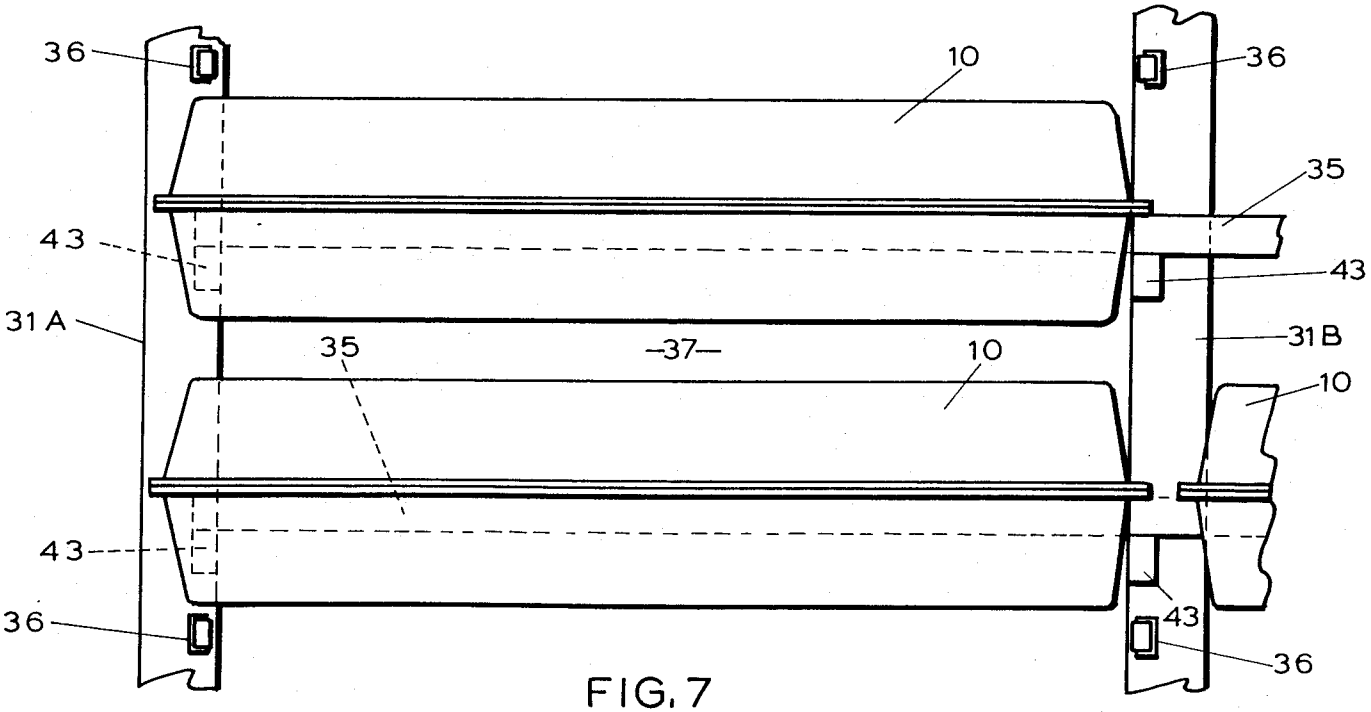
FIG. 7 is a partial side view along the line VII—VII in FIG. 4.
Figure 8:
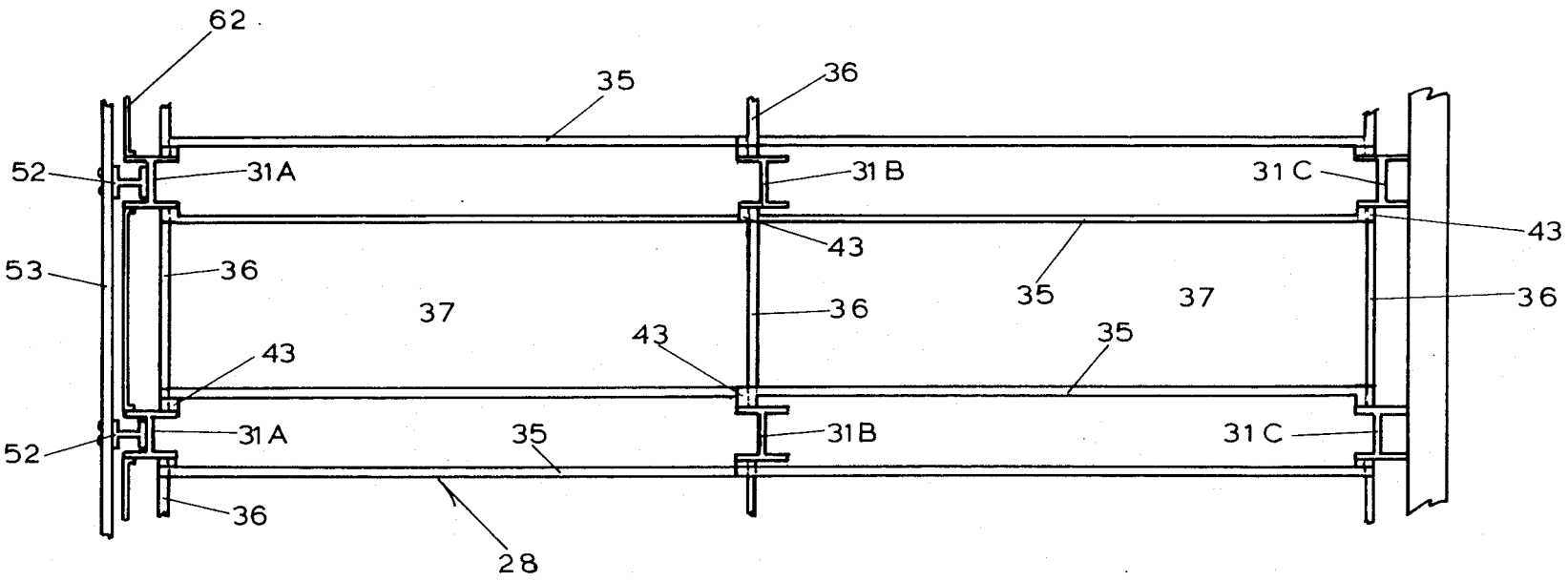
FIG. 8 is a partial, partially broken away plan view of the mausoleum shown in FIG. 3, with caskets removed.

Elongated fiberglass rails 35 are each mounted at opposite end portions thereof on brackets 43 associated with front and rear I-beams 31A and 31C, and are further mounted along the length thereof to a bracket 43 mounted on the middle beam 31B. The fiberglass rails 35 and crossbars 36 are preferably C-shaped in cross-section as shown in FIGS. 5 and 7. Each rail 35 extends horizontally in the front-to-rear direction of the mausoleum 26.

The rails 35 are secured to the brackets 43 by the above-mentioned nut and bolt assemblies 46, which are inserted through holes in the respective rails 35, brackets 43, and flanges 44. Pairs of rails 35 disposed on opposite sides of each space 37 are used to support each fiberglass casket 10. The rails 35 of each pair are spaced apart by an appropriate distance so that the casket 10 can be inserted therebetween and the flange 13 can be brought into abutment with the upper faces of the associated rails 35. Each rail 35 is laterally spaced apart from the I-beams 31A, 31B and 31C to which it is connected by the corresponding brackets 43.

As shown in detail in FIG. 6, an I-beam 52 connects each front I-beam 31A with marble facing panels 53, which form the front wall of the housing 27 as illustrated in FIG. 3. The I-beams 52 are slightly smaller than the I-beams 31 and are rotated 90 degrees with respect to the I-beams 31, so that the rear flange 56 of each I-beam 52 is secured to the central connecting portion 55 of the associated I-beam 31A by a pair of nut and bolt assemblies 58, and front flanges 57 of the I beam 52 are each separately connected to adjacent marble facing panels 53 by means of screws 61. The heads of the screws 61 have a decorative brass escutcheon. Each space 37 is closed by an inner fiberglass door 62 which is secured at opposite lateral ends thereof to front end portions of the flanges 44 by means of L-shaped brackets 64. Each door 62 is secured by fasteners 66 to the laterally projecting portions of the brackets 64, and the inwardly extending portions of the brackets 64 are preferably welded to the outer surfaces of the flanges 44 of the I-beams 31A.

With the exception of the I-beams 52, the inner support structure 28 of the mausoleum 26 need not be connected to the surrounding housing 27, which typically comprises cement floor, side walls and ceiling. No vent or drainage systems are required for the mausoleum of the present invention because the caskets 10 are virtually proof against deterioration and do not leak. The mausoleum according to the invention also eliminates the need for interior top, bottom and side walls for isolating each space 37. The inner support structure 28 of the mausoleum can be made entirely from fiberglass components. More particularly, the structural members, including I-beams 31, brackets 43, rails 35, and crossbars 36, are made from fiberglass in order to achieve excellent tolerances. If desired, the various nut and bolt assemblies used to assemble the fiberglass parts of the support structure 28 may be made from stainless steel.

The fiberglass used to fabricate the structural members of the support structure 28 preferably has the following allowable stresses. In the longitudinal direction, the fiberglass has a tensile strength of at least 60,000 p.s.i., a compressive strength of at least 30,000 p.s.i., a flexural strength of at least 60,000 p.s.i. a flexural modulus of at least $30\times10^6$ p.s.i., a shear strength of 5,500 p.s.i., and a bearinq strength of at least 30,000 p.s.i. In the transverse direction, the fiberglass has a tensile strength of at least 7,000 p.s.i., a compressive strength of at least 15,000 p.s.i., a flexural strength of at least 10,000 p.s.i., a flexural modulus of at least $0.8\times10^6$ p.s.i., a shear strength of at least 5,500 p.s.i., and a bearing strength of at least 30,000 p.s.i. These specifications are preferred for fabricating an inner supoort structure 28 having sufficient strength to support the caskets 10 in the embodiment shown in the drawings.

In practice, bottom 11 of casket 10 is used as a body container throughout the funeral services. Crypt couch 11 can be, if desired, placed in a more ornate rented casket for viewing at the funeral home and during memorial services. For interment fiberglass crypt couch 11 is removed from the casket. Top cover 12 is then placed in position over the crypt couch 11, and flanges 13 and 14 sealed placed in sealing relationship. Sealing and fastening can be accomplished with a sealing material, such as epoxy or silicone, to insure that no leakage of gases or fluids will occur from the sealed casket. The sealed crypt couch is then taken to the mausoleum and positioned on respective rails 35 for permanent storage.

It will be understood that the above description is of preferred exemplary embodiments of the present invention, and the invention is not limited to the specific forms shown. Modifications may be made in the design and arrangement of the elements without departing from the scope of the present invention as expressed in the appended claims.

I claim:

1. A mausoleum for storing caskets each such casket having a central lateral flange, comprising:

a plurality of spaced apart, parallel, lateral rows of vertical beams, each of the beams in each row being spaced apart at regular intervals, each of said beams in each row being riigidly connected to adjacent beams in that row by a lateral crossbar, each of said beams further having a plurality of vertically spaced pairs of laterally extending, cantilevered brackets mounted thereon, the brackets of each pair extending in opposite lateral directions, and further comprising end beams mounting said cantilevered brackets upon one side only, said support frame further including a plurality of elongated, parallel rails rigidly secured to said brackets, said rails being aligned perpendicular to said rows of said beams, each of said rails being mounted at opposite end portions thereof to one of said brackets, said rails being positioned so that caskets can be mounted on and between a pair of said rails connected to adjacent beams, the central flange of each casket abuting the upper surface of each rail of said pair so that each casket is supported by an associated pair of said rails.

2. A mausoleum comprising a plurality of fiberglass caskets, each having a central lateral flange; a support frame having a plurality of spaced apart, parallel, lateral rows of vertical fiberglass I-beams, each of the I-beams in each row being spaced apart at regular intervals, each of said I-beams in each row being rigidly connected to adjacent I-beams in that row by a plurality of parallel, vertically spaced apart rows of lateral fiberglass crossbars, each of said I-beams being aligned so that a pair of oppositely facing channels defined thereby open forwardly and rearwardly, respectively, said I-beams further having a plurality of pairs of laterally extending, cantilevered brackets mounted thereon, the brackets of each pair extending in opposite lateral directions, said support frame further including a plurality of elongated, parallel fiberglass rails rigidly secured to said brackets, said rails being aligned perpendicular to said rows of said I-beams, each of said rails being mounted at opposite end portions thereof to one of said brackets, said rails being positioned so that each of said fiberglass caskets are mounted on and between a pair of said rails connected to laterally adjacent I-beams, the central flange of each casket abuting the upper surface of each rail of said pair so that each casket is supported by an associated pair of said rails; and a housing enclosing said caskets and inner support frame, a front wall of said housing having means for accessing said inner support structure and said caskets.

3. A mausoleum as claimed in claim 2, wherein each of said fiberglass caskets comprises a lower, trough-shaped, upwardly opening bottom portion made of fiberglass having an upper peripheral lateral flange, a trough-shaped, downwardly opening bottom portion cover made of fiberglass having a lower peripheral lateral flange superposed on said upper flange of said bottom portion, and a layer of sealant which bonds said upper and lower flanges together to seal said casket in an airtight fashion.

4. A mausoleum as claimed in claim 3, wherein each of said caskets further comprises a plurality of transverse, spaced apart reinforcing strips embedded in a bottom wall of said bottom portion.

5. A mausoleum as claimed in claim 4, wherein said reinforcing strips comprise wooden boards.

6. A mausoleum as claimed in claim 2, wherein each of the brackets of each of said pairs is mounted on opposite outer end faces of opposing end flanges of the associated I-beam, and said pairs of brackets are vertically spaced apart at regular intervals along the length of each of said I-beams.

7. A mausoleum as claimed in claim 2, wherein said caskets are spaced apart from each other and are free of contact with said support structure other than at said rails.

8. A mausoleum as claimed in claim 6, wherein said pairs of brackets are mounted on said I-beams at positions vertically offset from said crossbars.

* * * * *